US009371149B2

(12) United States Patent
Guo

(10) Patent No.: US 9,371,149 B2
(45) Date of Patent: Jun. 21, 2016

(54) STRUCTURE OF PAPER CUP

(71) Applicant: Tzer-Huang Guo, Keelung (TW)

(72) Inventor: Tzer-Huang Guo, Keelung (TW)

( * ) Notice: Subject to any disclaimer, the term of this patent is extended or adjusted under 35 U.S.C. 154(b) by 0 days.

(21) Appl. No.: 13/646,738

(22) Filed: Oct. 8, 2012

(65) Prior Publication Data

US 2016/0114929 A1 Apr. 28, 2016

(51) Int. Cl.

| | |
|---|---|
| ***B65D 3/14*** | (2006.01) |
| ***B65D 3/06*** | (2006.01) |
| ***B65D 6/00*** | (2006.01) |
| ***B65D 25/34*** | (2006.01) |

(52) U.S. Cl.

CPC .. *B65D 3/06* (2013.01); *B65D 3/14* (2013.01); *B65D 13/04* (2013.01); *B65D 25/34* (2013.01)

(58) Field of Classification Search

CPC ..... B65D 3/06; B65D 3/14; B65D 13/04
USPC ..... 229/400; 206/505, 515, 519, 520
See application file for complete search history.

(56) References Cited

U.S. PATENT DOCUMENTS

| | | | | | |
|---|---|---|---|---|---|
| 1,235,750 | A * | 8/1917 | Wright | B65D 3/14 | 229/5.6 |
| 1,573,598 | A * | 2/1926 | Wright | B65D 3/14 | 229/5.6 |
| 1,771,765 | A * | 7/1930 | Benson | 229/400 | |
| 1,904,331 | A * | 4/1933 | Sidebotham | 229/5.5 | |
| 2,050,028 | A * | 8/1936 | Wilcox | B65D 3/14 | 220/495.11 |
| 2,110,616 | A * | 3/1938 | Wilcox | 229/5.5 | |
| 2,969,901 | A * | 1/1961 | Behrens | 229/400 | |
| 3,144,971 | A | 8/1964 | Wommelsdorf | | |
| 3,503,310 | A * | 3/1970 | Goetz | 229/400 | |
| 4,051,951 | A * | 10/1977 | Smith | 229/5.5 | |
| 4,971,241 | A * | 11/1990 | Wagers | B65D 45/32 | 229/5.5 |
| 5,766,709 | A | 6/1998 | Geddes et al. | | |
| 7,195,805 | B2 * | 3/2007 | Breining et al. | 229/400 | |
| 7,311,243 | B1 * | 12/2007 | Konzal et al. | 229/400 | |

FOREIGN PATENT DOCUMENTS

| | | |
|---|---|---|
| JP | 4743372 B2 | 5/2011 |

* cited by examiner

*Primary Examiner* — Gary Elkins
(74) *Attorney, Agent, or Firm* — Muncy, Geissler, Olds & Lowe, P.C.

(57) ABSTRACT

An improved structure of paper cup, which comprising: a cup body and bottom; the cup body is designed with an annular side wall, and an outward folded arced cup edge is set on the ring edge at one end; the annular side wall is provided with an annular side wall mated with the annular side wall of the cup body far away from the cup edge to form holding space; the cup body and bottom form a holding space; particularly, an inflexed edge is formed at the annular side walls where the cup body is abutted with the cup bottom, thus reducing the height of the annular side wall for the mating of the cup body and bottom; when a large number of paper cups are stacked, the gap between cups could be reduced, thus increasing the storage amount and saving the storage and transportation cost.

6 Claims, 9 Drawing Sheets

STRUCTURE OF PAPER CUP

BACKGROUND OF INVENTION

1. Field of the Invention

The present invention relates generally to an improved paper cup, and more particularly to an innovative one which could be stacked to reduce gap and save storage and transportation cost.

2. Description of Related Art

Referring to FIG. 1, a conventional paper cup 1 comprises a cup body 2 and a bottom 3, which form a holding space. The common manufacturing process includes: preparing material—prepare the raw material with PE-coated paper and divide into cup body and bottom; pattern printing—print the pattern on the paper used to make cup body; die cutting—cut the paper of cup body with printed pattern into fan-shaped sheets to make paper cup; loading materials—load the fan-shaped sheets and cup bottom paper onto the table of paper cup making machine; cup body bonding—the fan-shaped sheets are heated and bonded into tubular shape via the paper cup making machine; cup bottom cutting—cut the entire cup bottom paper into round paper sheets of desired bottom size via the paper cup making machine; cup bottom bonding—heat up to bond the tubular cup body and bottom paper sheets via the machine; cup rim rolling—roll the upper edge of the paper cup out of the cup rim to complete the fabrication of a finished product.

Referring also to FIG. 1, in the configured pattern of the cup body 2 and bottom 3, the cup body 2 is designed with an annular side wall 21, and an outward folded cup rim 22 of height "h" is set on the ring edge (cup rim); the cup bottom 3 is also designed with an annular skirt 31 mated with the annular side wall 21 of the cup body 2 far away from the cup rim 22; the annular side wall 21 and annular skirt 31 where the cup body 2 is mated with the cup bottom 3 has a height of "H", generally, "H" is higher than "h".

According to the aforementioned paper cup, when multiple paper cups are stacked, the bottom edge of each paper cup is abutted onto the inner side of the bottom of the paper cup below; yet, as "H" is higher than "h", there is a gap between every two cup rims when multiple paper cups are stacked, thus causing problems in stacked storage and transportation. As for the storage, space-saving could be made more effectively to pile up more paper cups in the same box or space; relatively, the cost of container transportation could also be reduced. Thus, it is necessary to design a kind of paper cup which is easier to stack without any redundant gap.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

SUMMARY OF THE INVENTION

The primary objective of the present invention is to provide a brand new structure of paper cup, helping to effectively reduce the stacking gap and transportation cost based on the special cup bottom design.

Another objective of the present invention is to provide a characterized structure of paper cup, helping to increase the strength, avoid softening and realize robust and anti-skidding arrangement, based on the special cup bottom design.

The third objective of the present invention is to provide an improved paper cup structure with good sealing effect; helping to reduce stacking space and further improve leak-proof effect, based on the special mating design of the cup body and bottom.

The paper cup structure of the present invention comprises generally a cup body and a bottom; the cup body is provided with an annular side wall, and an outward folded arced cup rim is set on the ring edge at one end; the cup bottom is provided with an annular side wall and bonded with the inner side of the annular side wall of the cup body far away from the cup rim; so the cup body and bottom form a holding space; particularly, an inflexed edge is formed at the annular side walls where the cup body is abutted with the cup bottom, thus reducing the height of the annular side wall for mating of the cup body and bottom.

With this design, when a large number of paper cups are stacked, the inflexed edge of each paper cup bottom could be closely abutted onto the inner side of the bottom of paper cup below, and the cup rims of stacked cup bodies are kept in contact to reduce the gap, thus, this could achieve maximum storage by effectively using the storage space and then save the transportation cost.

Of which, the inflexed edge of the paper cup could be of a two-layer inflexed edge structure formed by repetitively bending the annular side wall of the cup body, or a three-layer inflexed edge structure formed by extending the cup bottom's annular side wall to the cup body's annular side wall.

The present invention will be more readily understood with reference to the accompanying detailed description and drawings.

DETAILED DESCRIPTION OF THE ILLUSTRATED EMBODIMENTS

Figure 1:
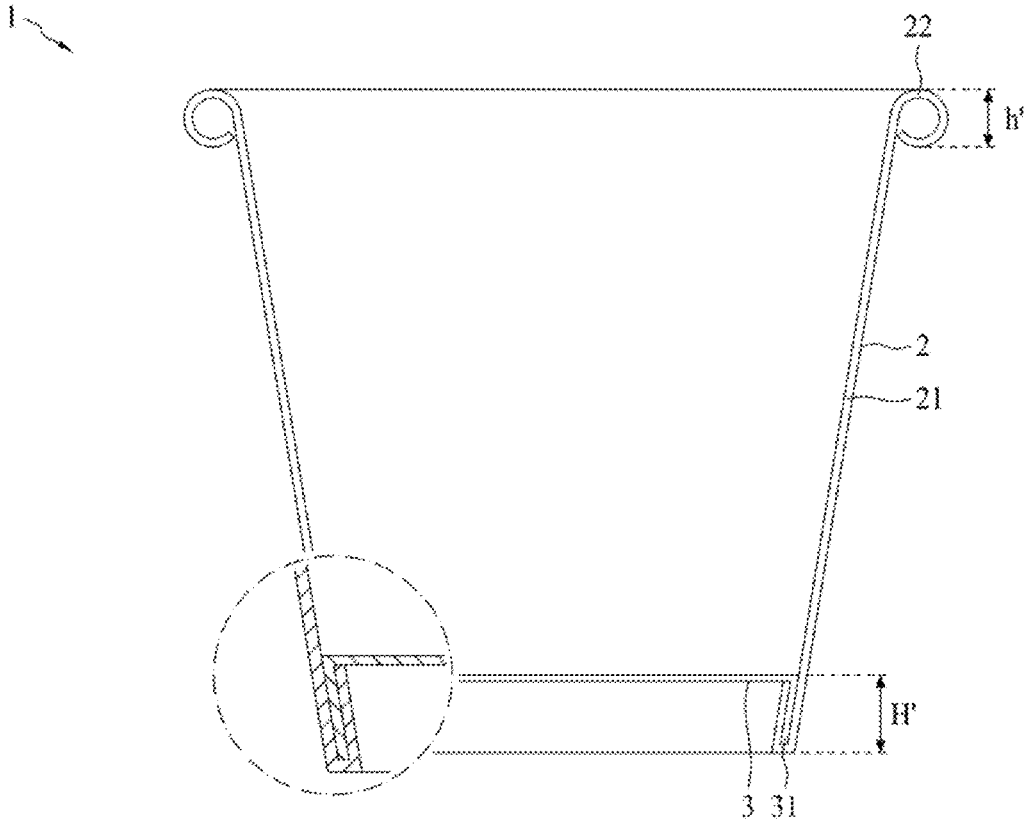
FIG. 1: a lateral view of the conventional paper cup.
Figure 2:
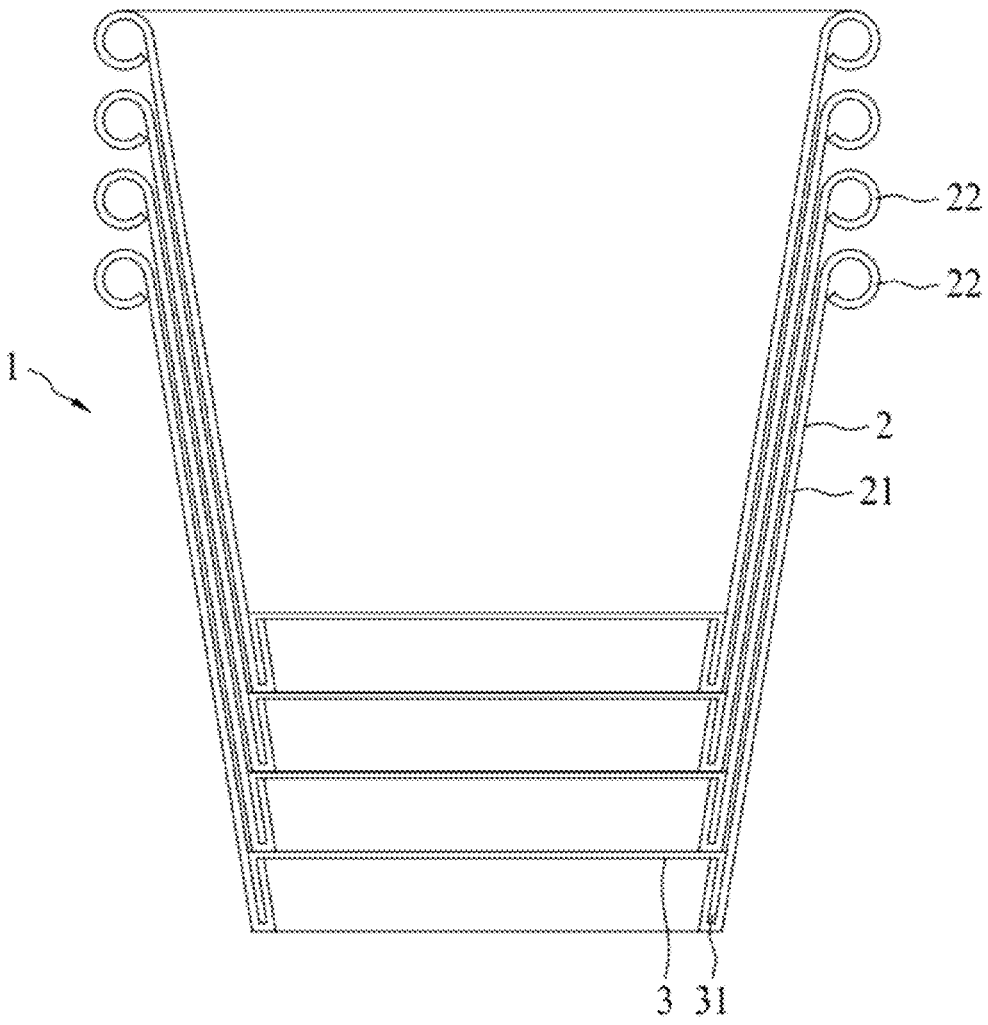
FIG. 2: a sectional view showing the stacking state of the conventional paper cup.
Figure 3:
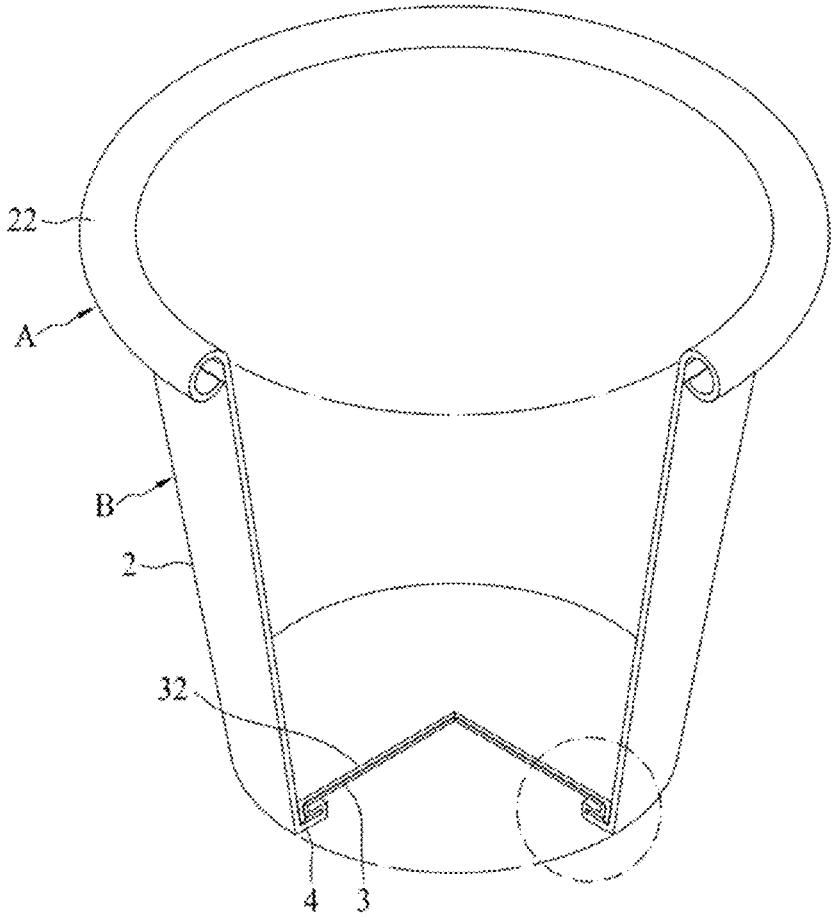
FIG. 3: a perspective & or partial sectional view of the paper cup of the present invention
Figure 3:
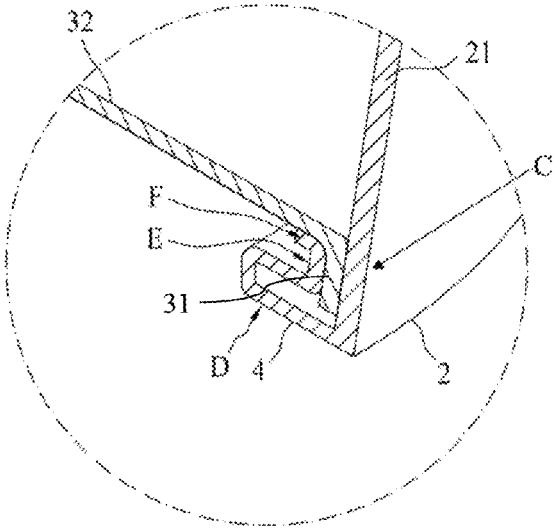
Figure 4:
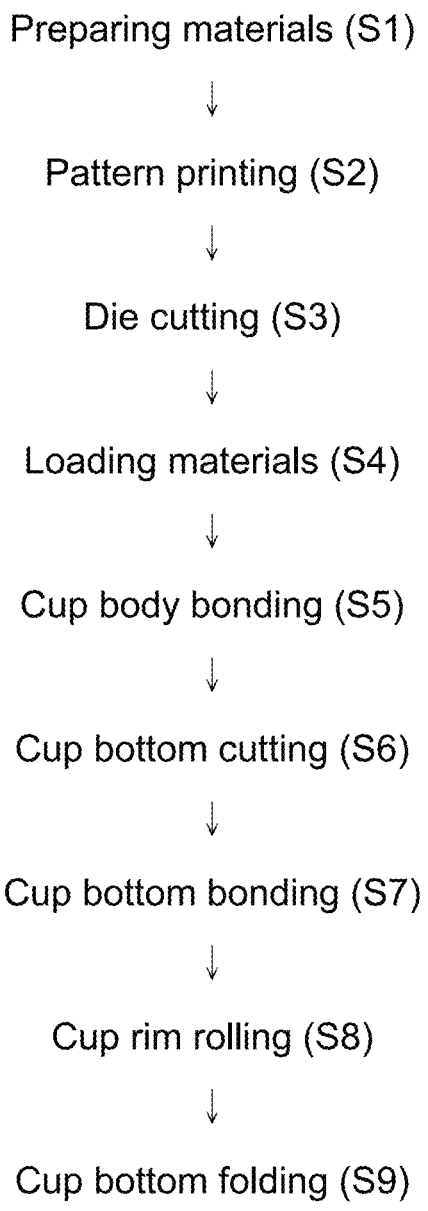
FIG. 4: a manufacturing process chart of the cup body of the present invention.

FIG. 3 depicts a preferred embodiment of the paper cup structure, wherein the paper cup 1 generally comprises a cup body 2 and a cup bottom 3. The cup body 2 is made of a paper sheet, and to facilitate the discussion, the paper sheet is fictionally divided into multiple continuous sections, designated with alphabetic letters A to F in FIG. 3. The cup body 2 is designed with an annular side wall 21, and an outward folded arced cup rim 22 is set on the ring edge at one end; the cup bottom 3 has a floor 32 and an annular skirt 31 depending from the periphery of the floor 32. The annular skirt 31 is mated with the annular side wall 21 of cup body 2 at the lower end of the cup rim 22 to form a bonding portion. The cup body 2 and the floor 32 of the cup bottom 3 define a holding space. As illustrated in FIG. 3, the cup rim is formed from the first section (section A) of the paper sheet, while the portion of the annular side wall 21 that defines the holding space together with the floor 32 is formed of section B, which is next to section A. Further, the bonding portion at which the annular skirt 31 mated with the annular side wall 21, the annular skirt 31 is sandwiched between section C and section E of the annular side wall 21. An inflexed edge 4 is formed at the bottom of the bonding portion, where the cup body is abutted with the cup bottom. Specifically, the inflexed edge 4 is formed from section D of annular side wall 21, which is folded back and then flexed inwardly. Thus, the height of the annular skirt 31 for the mating of the cup body and bottom is reduced; this could reduce the height of the annular skirt 31 for mating of the cup body 2 and bottom 3, allowing the height to be equal to or less than the height of the cup rim 22. The paper sheet also has a section F, which follows the section E, and is bonded to the bottom face of the floor 32, as illustrated in FIG. 3.

The paper cup of FIG. 3 of present invention is manufactured by the following process:

Preparing materials (S1)—prepare the raw material with PE-coated paper and divide into cup body and bottom;

Pattern printing (S2)—print the pattern on the paper used to make cup body;

Die cutting (S3)—cut the paper of cup body with printed pattern into fan-shaped sheets to make paper cup (i.e. annular side wall to form cup body);

Loading materials (S4)—load the fan-shaped sheets and cup bottom paper onto the table of paper cup making machine;

Cup body bonding (S5)—the fan-shaped sheets are heated and bonded into tubular shape via the paper cup making machine;

Cup bottom cutting (S6)—cut the entire cup bottom paper into round paper sheets of desired bottom size via the paper cup making machine;

Cup bottom bonding (S7)—heat up to bond the tubular cup body and bottom paper sheets via the machine [including 4 processes such as heating and pressing, etc.]

Cup rim rolling (S8)—roll the upper edge of the paper cup out of the cup rim via the paper cup making machine;

Cup bottom folding (S9)—fold inwards the covered and pressed cup bottom via the paper cup making machine to reduce the bottom height; [this process aims to reduce stacking space without affecting safety of the present structure]; it is difficult for folding in such short distance since the overlapping height of the cup body and cup bottom is generally less than 3 mm, and the design of applied mechanical equipment is complicate and precise.

Complete the fabrication of finished product (10).

Figure 5:
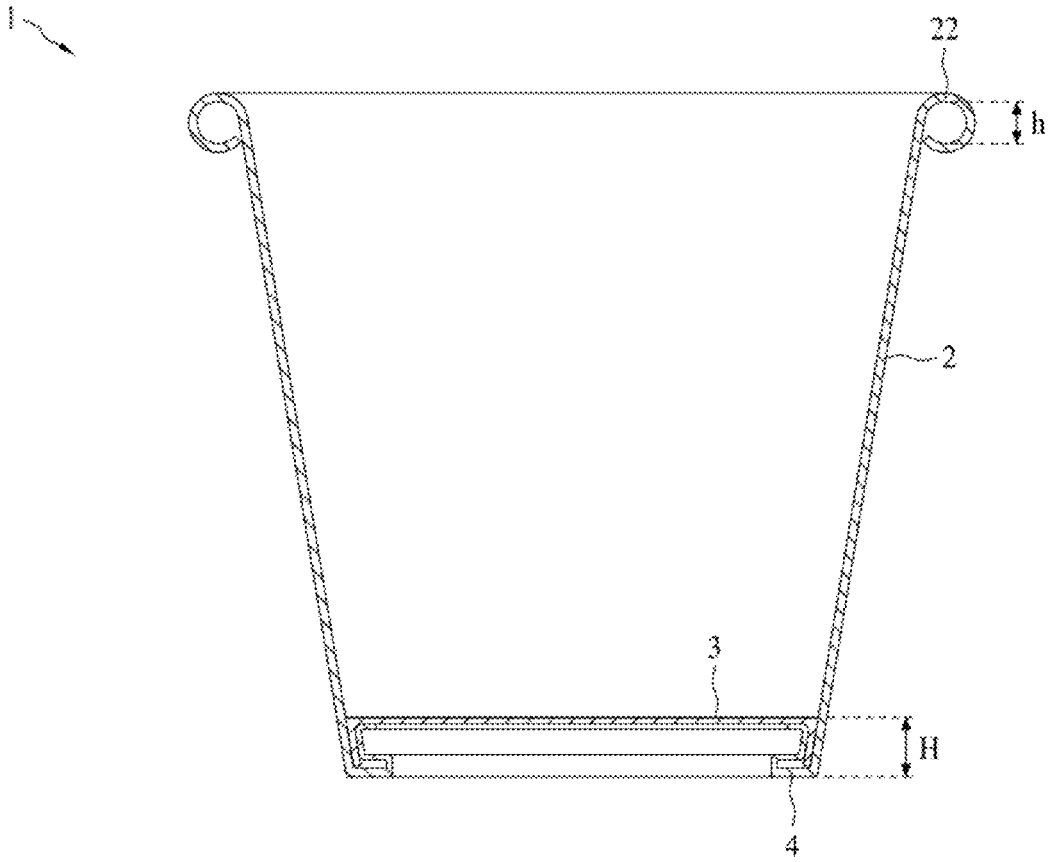
FIG. 5: a structural view of the paper cup of present invention.

FIG. 5 depicts a perspective view of a preferred embodiment of paper cup structure, wherein the paper cup 1 is formed by combining the cup body 2 and bottom 3 through above-specified process; of which, the cup body 2 is designed with an annular side wall 21, and an outward folded cup rim 22 of height "h" is set on the ring edge (cup rim); the cup bottom 3 is also designed with an annular skirt 31 mated with the annular side wall 21 cup rim at the bonding portion. The cup body 2 and the floor of the cup bottom 3 form a holding space. An inflexed edge 4 is formed at bottom of the bonding portion, allowing height "H" of the bonding portion (i.e., the distance between the cup bottom 3 and inflexed edge 4) to be equal to or less than "h".

Figure 7:
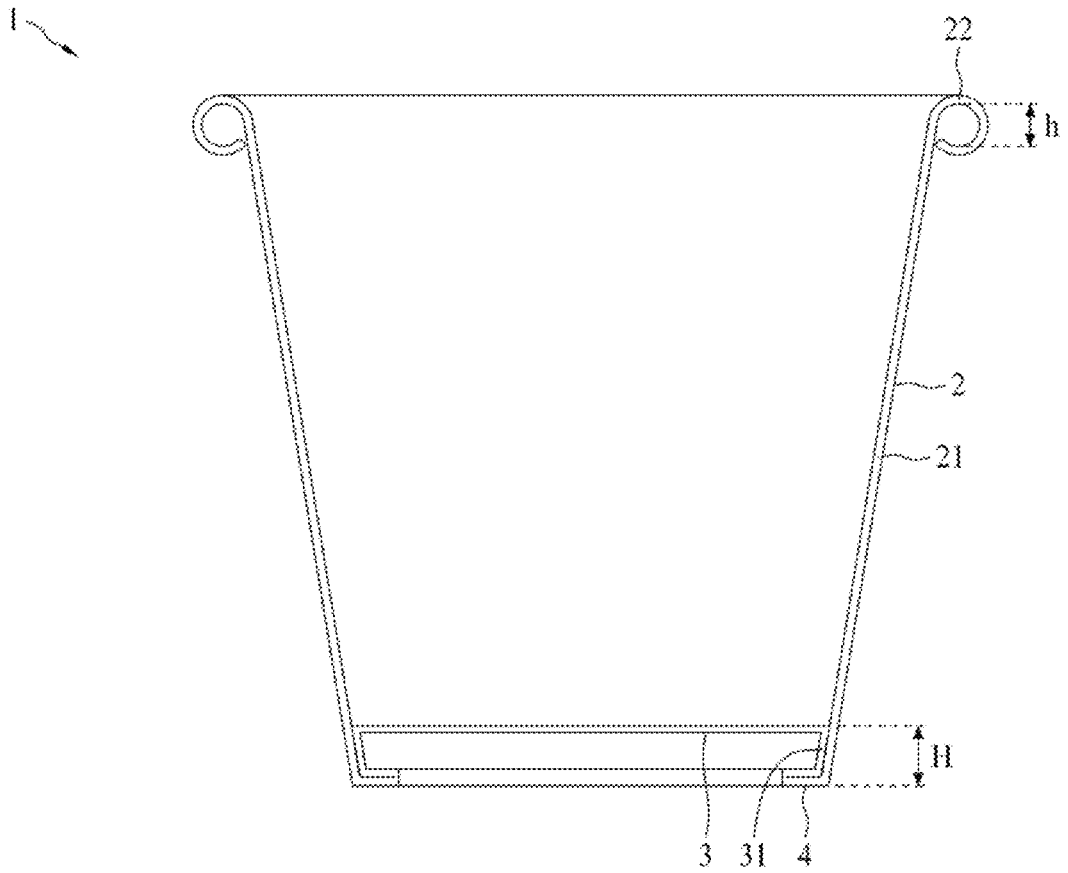
FIG. 7: a structural view of another pattern of paper cup of the present invention.

Referring also to FIGS. 5 and 7, the embodiment of said inflexed edge 4 is formed by bending and extending the annular side wall 21 of the cup body 2, or referring to FIG. 7, formed by bending the annular side wall 21 and the annular skirt 31 of the cup body 2 and bottom 3; thus, when paper cups are stacked, the inflexed edge 4 of the bottom of each paper cup 1 could be closely abutted onto the inner side of the bottom 3 of the paper cup 1 below, and the cup rims 22 of stacked cup bodies are kept in contact to reduce the gap.

Figure 6:
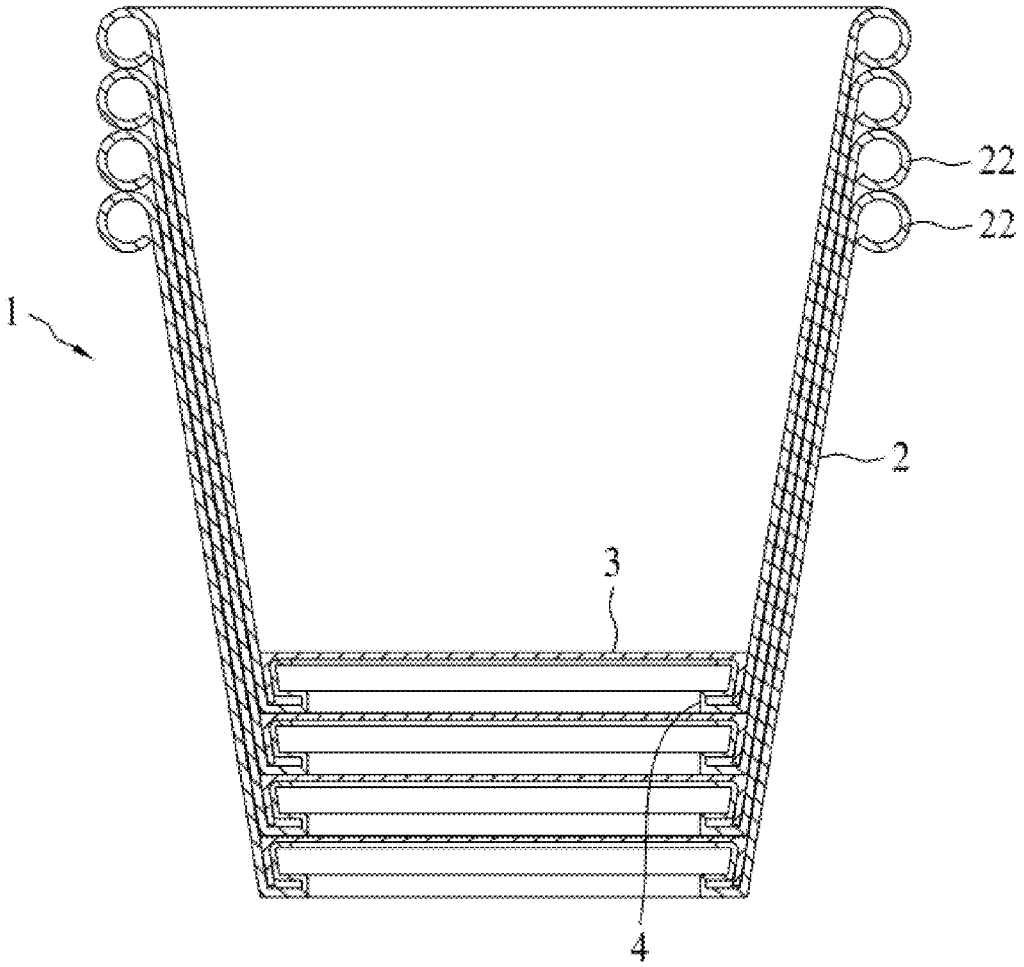
FIG. 6: a stacking view of the paper cup based on FIG. 5.
Figure 8:
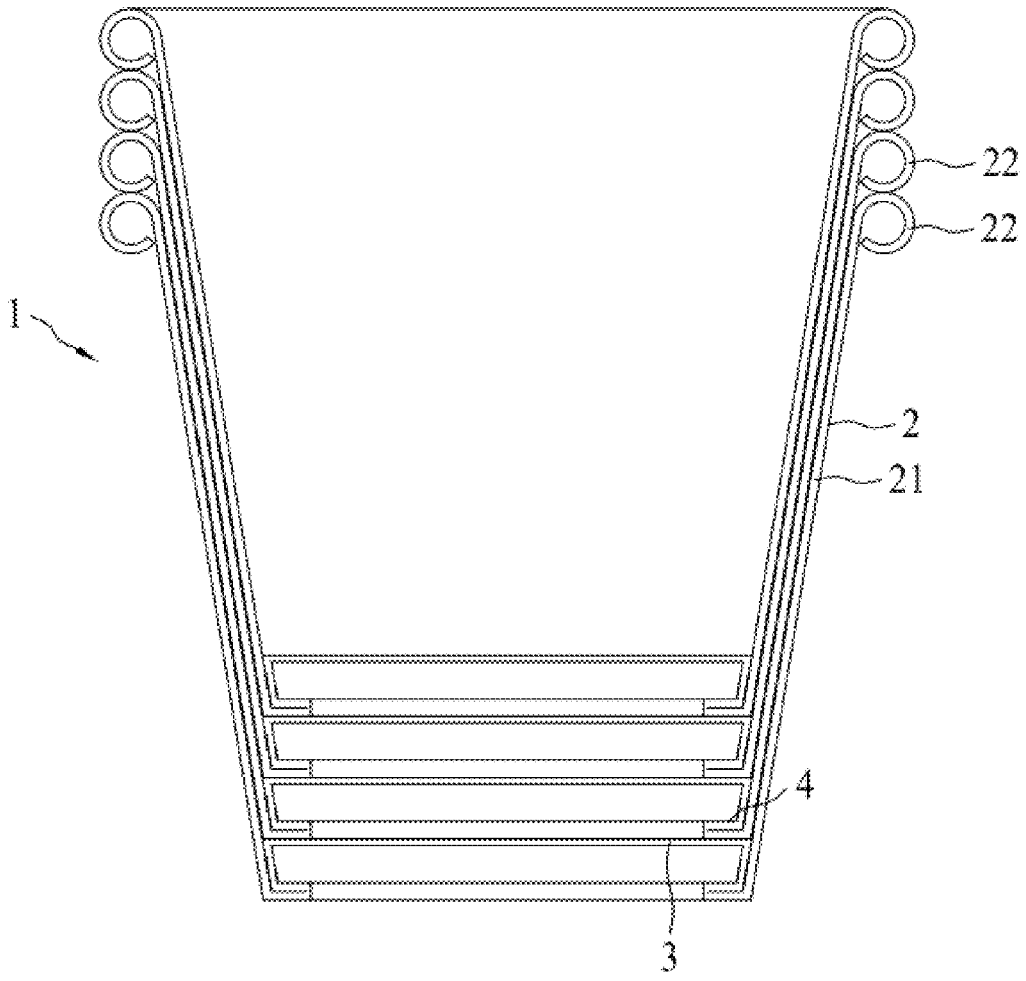
FIG. 8: a stacking view of the paper cup based on FIG. 7.

FIGS. 6 and 8 depict a perspective view of stacked paper cups, it is clearly shown that, when a large number of paper cups 1 are stacked, the inflexed edge 4 of the bottom of each paper cup 1 could be closely abutted onto the inner side of the bottom 3 of the paper cup 1 below, and the cup rims of stacked cup bodies are kept in contact to reduce the gap, thus saving the storage space and transportation cost.

With the design of the cup bottom, the inflexed edge of the present invention permits to reduce the height of cup bottom, thus addressing the shortcomings of prior art such as: larger space between the paper cups that results in larger storage and transportation cost; conversely, the improvements hereto could reduce the stacking gap of paper cups, thus minimizing the storage space and increasing the storage amount by about 30% for lower transportation cost.

Figure 9:
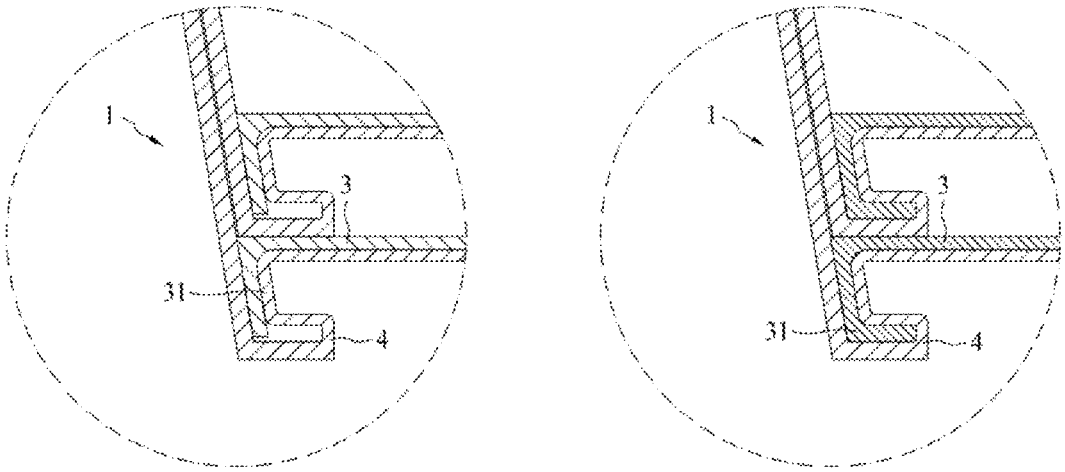
FIG. 9: a partial structural view of the cup bottom based on FIGS. 5 and 7.

FIG. 9 also depicts a partial structural view of the cup bottom based on FIGS. 5 and 7; as for the paper cup 1 shown in the left part of the figure, the inflexed edge 4 is of a two-layer bonding structure with leak-proof effect, and the annular skirt 31 of the cup bottom 3 is not included; such structure is applied to small-capacity (under 9 oz) paper cups. As for the paper cup 1 shown in the right part of the figure, the inflexed edge 4 is of a three-layer bonding structure that comprises extended and bent annular skirt 31 of the cup bottom 3 in combination with a two-layer structure forming the inflexed edge 4 with better leak-proof effect; such structure is applied to large-capacity (above 12 oz) paper cups. According to the design of above-specified inflexed edge 4, this could reduce the stacking space of paper cup 1, and realize better tightness and leak-proof effect by the two-layer or three-layer inflexed edge 4.

To sum up, the "improved structure of paper cup" of the present invention is of an innovative and improved structure compliant with the relevant provisions of Patent Law, so the patent application is hereby claimed in accordance with relevant laws.

Although the invention has been explained in relation to its preferred embodiment, it is to be understood that many other possible modifications and variations can be made without departing from the spirit and scope of the invention as hereinafter claimed.

The invention claimed is:

1. A paper cup, comprising:

a cup bottom, comprising a floor and an annular skirt depending from the periphery of the floor; and a cup body, formed of a sheet material, wherein the sheet material comprises, sequentially, a first section to a fifth section, and the cup body comprises, a cup rim, disposed at the upper end of the paper cup, and formed from the first section of the sheet material;

an annular side wall, configured to define a holding space with the floor, and formed from the second section of the sheet material;

a bonding portion, at which the annular skirt is bonded with and sandwiched between the third section and fifth section of the sheet material; and an inflexed edge, formed by folding back the fourth section of the sheet material and flexing the folded fourth section inwardly, wherein the annular skirt does not extend into the inflexed edge.

2. The paper cup according to claim 1, wherein the height of the bonding portion is equal to or less than the height of the cup rim.

3. The paper cup according to claim 1, wherein the height of the bonding portion is less than 3 mm.

4. The paper cup according to claim 1, wherein the sheet material further comprises a sixth section next to the fifth section and bonded with the lower face of the floor.

5. The paper cup according to claim 1, wherein the sheet material comprises a polyethylene-coated paper sheet.

6. The paper cup according to claim 5, wherein the sheet material further comprises a pattern layer printed on the outer surface thereof.

* * * * *